US005087854A

United States Patent [19]

van Uden et al.

[11] Patent Number: 5,087,854

[45] Date of Patent: Feb. 11, 1992

[54] DISPLAY DEVICE AND METHODS OF MANUFACTURING SUCH A DISPLAY DEVICE

[75] Inventors: Maria C. van Uden; Ronald van der Wilk; Josephus J. van Moorsel; Werner D. P. Kauwenberg, all of Eindhoven, Netherlands

[73] Assignee: U.S. Philips Corporation, New York, N.Y.

[21] Appl. No.: 606,297

[22] Filed: Oct. 31, 1990

[30] Foreign Application Priority Data

Nov. 8, 1989 [NL] Netherlands ..... 8902758

[51] Int. Cl.[5] ..... H01J 9/00; H01J 29/07

[52] U.S. Cl. ..... 313/403; 445/37; 430/5

[58] Field of Search ..... 445/5, 24, 37, 47; 430/5; 313/402, 403; 156/644

[56] References Cited

U.S. PATENT DOCUMENTS

| | | | |
|---|---|---|---|
| 3,653,900 | 4/1972 | Black | 156/644 X |
| 3,713,922 | 1/1973 | Lepselter et al. | 430/5 X |
| 4,427,395 | 1/1984 | Lipp et al. | 445/37 |
| 4,650,435 | 3/1987 | Tamutus | 445/37 X |
| 4,675,525 | 6/1987 | Amingual et al. | 430/5 X |

*Primary Examiner*—Kenneth J. Ramsey
*Attorney, Agent, or Firm*—Paul R. Miller

[57] ABSTRACT

A display device having a pattern of conductors recessed on an electrode, thus reducing the risk of the pattern of conductors being damaged such as from a surface scratch. When the pattern of conductors and the plate are separated from each other by an insulating layer, the pattern of conductors screens the insulating layer from the electron beam. The method is characterized in that grooves are formed between the apertures, and an insulating layer and conducting layer are provided on the walls of the apertures and the grooves.

15 Claims, 5 Drawing Sheets

DISPLAY DEVICE AND METHODS OF MANUFACTURING SUCH A DISPLAY DEVICE

BACKGROUND OF THE INVENTION

The invention relates to a display device comprising a means for generating an electron beam and an electrode, said electrode comprising a plate having a pattern of apertures for transmittin the electron beam and a pattern of conductors of influencing the passage of the electron beam, the plate and the pattern being mechanically interconnected and electrically separated.

The invention also relates to methods of manufacturing a display device of the type mentioned in the opening paragraph.

A display device of the type mentioned in the opening paragraph and a method of manufacturing such a display device are known from U.S. Pat. No. 4,650,435. In the patent the display device comprises a cathode-ray tube, and the electrode comprises a focusing colour-selection electrode. Said focusing colour-selection electrode comprises a conducting plate having apertures for transmitting an electron beam. Ridges of insulating material are formed on either side of each aperture. Conducting strips provided on said ridges, form a pattern of conductors. The pattern of conductors and the conducting plate are thus mechanically interconnected but electrically separated by said ridges.

By applying a potential difference between the conducting plate and the conducting strips the electron beam is focused in the apertures. As a result hereof, the transmission through the colour selection electrode is increased.

The known display device has the disadvantage that the conducting pattern can be damaged relatively easily, such as by a scratch across the surface of the electrode. Scratches may be formed for example, during the treatment of the electrodes.

OBJECTS AND SUMMARY OF THE INVENTION

One of the objects of the invention is to provide a display device of the type mentioned in the opening paragraph by means of which the above disadvantage is overcome.

For this purpose, the display device according to the invention is characterized in that the pattern of conductors is constructed so as to be recessed in the plate, so that it cannot be damaged by a scratch across the surface.

An embodiment of the display device according to the invention is characterized in that each aperture of the plate is surrounded by a crater-shaped wall, in that grooves extend in the plate between the apertures, and in that the walls of the apertures and the walls of the grooves are provided with a conducting material.

By employing crater-shaped walls, the electron-optical properties are enhanced. A depth effect can be obtained such that the effectiveness of the influence of the electric field electrons is increased.

By virtue thereof, lower switching voltages are required and the current loss in the conductors is reduced.

When the pattern of conductors is separated from the plate by an insulating layer, the insulating layer and the pattern of conductors are preferably arranged such that the insulating layer is screened from the electron beam by the pattern of conductors, and the insulating layer cannot be charged by the electron beam.

A method according to the invention is characterized in that the apertures are formed in the plate and grooves are formed between said apertures, the plate is provided with an electrically insulating layer which covers at least the walls of the apertures and the grooves, the surface between the apertures and the grooves is covered with a further removable layer, after which a conducting material is provided over at least the walls of the apertures and the grooves, after which the removable layer is removed from at least the surface between the grooves and the craters.

An embodiment of the method according to the invention is characterized in that the removable layer is provided by means of roller coating.

An alternative method according to the invention is characterized in that apertures are formed in the plate, between which grooves are formed, the plate is provided with an electrically insulating layer which covers at least the walls of the apertures and the grooves, after which a conducting material is provided on the plate, at least the walls of the apertures and the grooves being covered by the conducting material, subsequently, a removable material is provided in the apertures and the grooves, after which the conducting material present between the apertures and the grooves is removed, and subsequently the removable material is removed from at least the apertures.

A further alternative method according to the invention is characterized in that apertures are formed in the plate, between which grooves are formed, the plate is provided with an electrically insulating layer covering at least the walls of the apertures and the grooves, after which a positive photoresist foil is applied to the plate on the side of the grooves, subsequently, the photoresist foil being exposed through the apertures and the exposed photoresist being removed, after which a conducting material is applied to the walls of the apertures and the grooves and the remaining photoresist is removed.

The above-mentioned methods have in common that the apertures and the grooves are preferably formed by etching. It has been found that, by virtue thereof, the transition between the apertures and the grooves is more gradual, i.e. no sharp edge is formed.

BRIEF DESCRIPTION OF THE DRAWING

The invention will be explained in greater detail in terms of exemplary embodiments and with reference to the accompanying drawings, in which.

DESCRIPTION OF PREFERRED EMBODIMENTS

Figure 1:
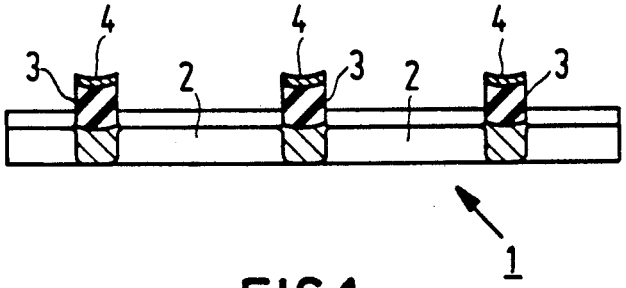
FIG.1 PRIOR ART
FIG. 1 and FIG. 2 are a sectional and a partly perspective elevational view, respectively, of a prior art electrode suitable for use in the known display device.
Figure 2:
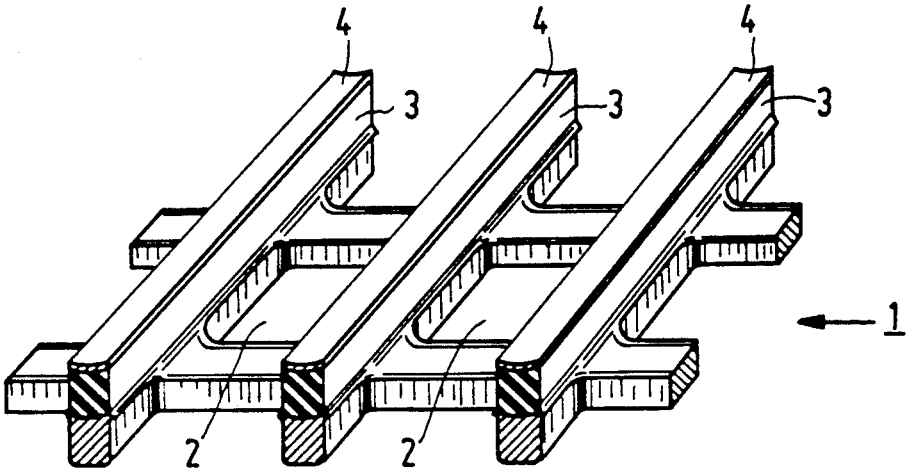
FIG.2 PRIOR ART

FIGS. 1 and 2 are a sectional and a partly perspective elevational view, respectively, of an electrode suitable for use in the known display device. An electrode 1 defines apertures 2. Ridges 3 of an insulating material are formed on the electrode 1 between the apertures. Conductors 4 are provided on said ridges 3. The passage of electrons through the apertures 2 of the electrode 1 can be influenced by applying voltages to said conductors 4. A disadvantage of the electrode 1, which is suitable for use in the known display device, is that the conductor can be damaged relatively easily.

Figure 3:
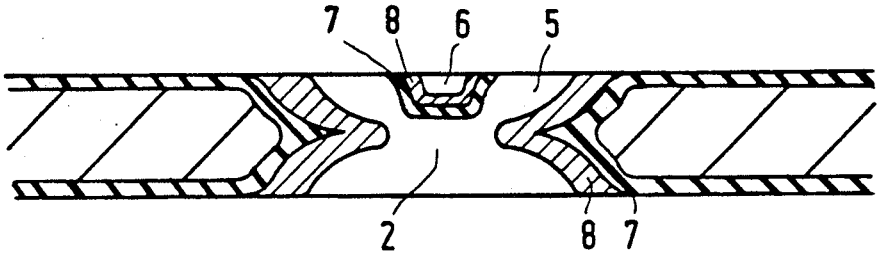
FIGS. 3 and 4 are a sectional and a partly perspective elevational view, respectively, of an electrode suitable for use in a display device according to the invention.
Figure 4:
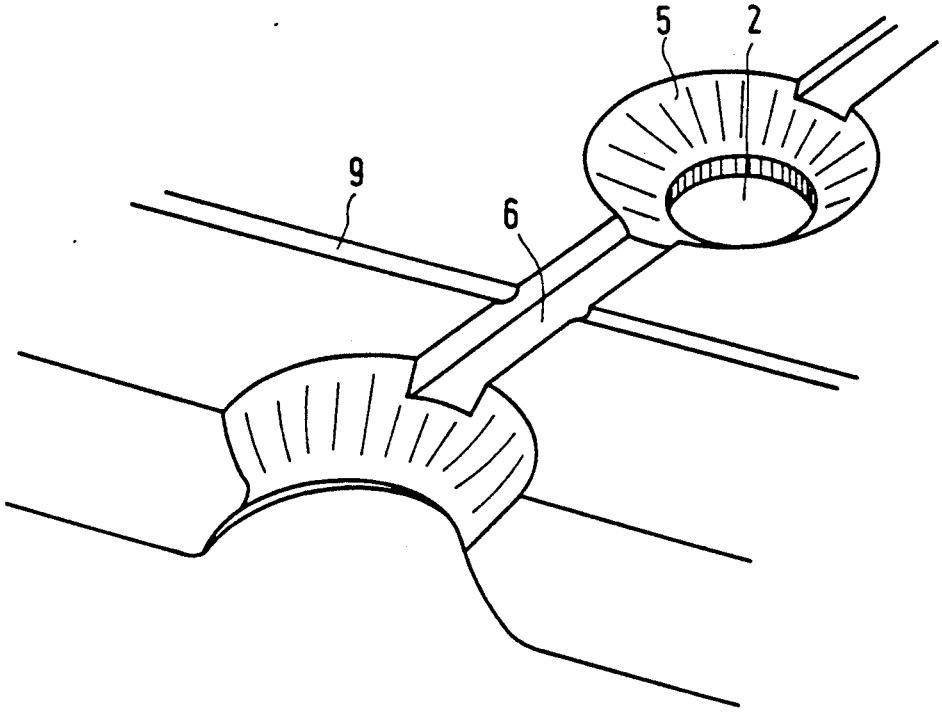

FIGS. 3 and 4 are a sectional and a partly perspective elevational view, respectively, of an electrode suitable for use in a display device according to the invention. In this example, apertures 2 in the electrode plate 1 are surrounded by crater-shaped walls 5. The apertures are interconnected by grooves 6. At least the walls 5 and the walls of the grooves 6 are coated with an insulating layer 7 on which a conducting layer 8 is provided. As the conducting layer 8 is formed so as to be recessed in the plate 1, the electric connection between the craters is not interrupted by a scratch 9 as shown in FIG. 4. It will be obvious that such a scratch would damage the ridges 3 shown in FIGS. 1 and 2 to such an extent that the conducting ridges may be interrupted.

Figure 5:
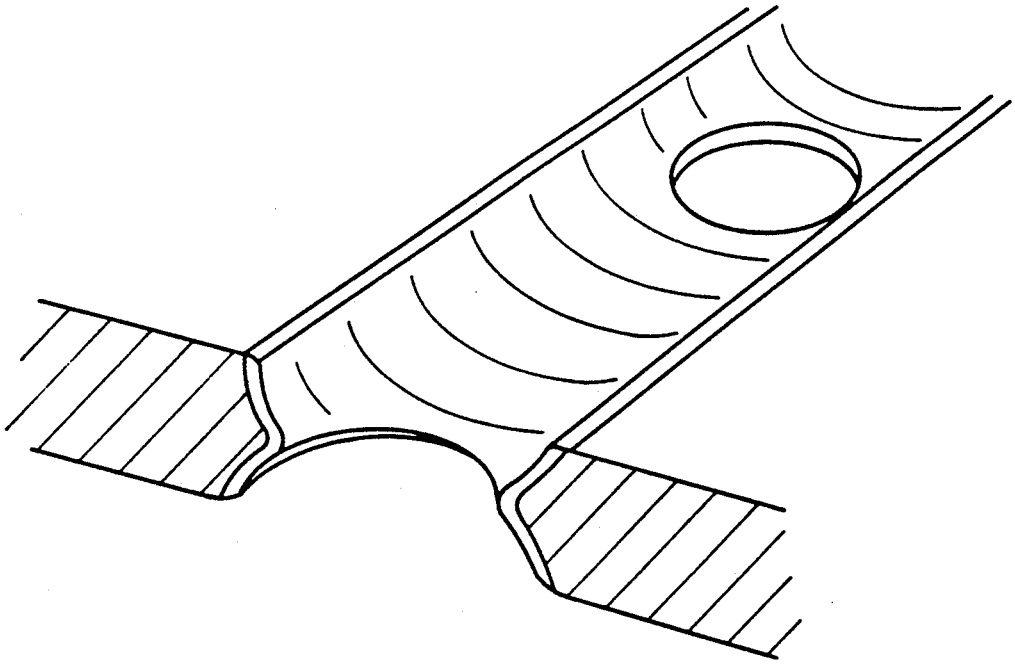
FIG. 5 is a partly perspective elevational view of another embodiment of an electrode which is suitable for use in a display device according to the invention.

FIG. 5 shows a further example of an electrode which is suitable for a display device according to the invention. In this electrode, the craters and the grooves are constructed as a single wide notch. Such an embodiment can be manufactured in a simpler manner.

By employing a suitable shape for the craters a depth effect can be obtained such that the effectiveness with which the electrons can be influenced by the conductors is increased.

By virtue thereof, lower switching voltages are necessary and the current loss in the conductors is reduced.

It is to be noted, that although in this and subsequent drawings, the craters and grooves are drawn so as to be accurately aligned this is not to be regarded as limiting the scope of the invention. For example, in an alternative embodiment the craters and grooves may be constructed so as to have a zigzag pattern.

Figure 6:
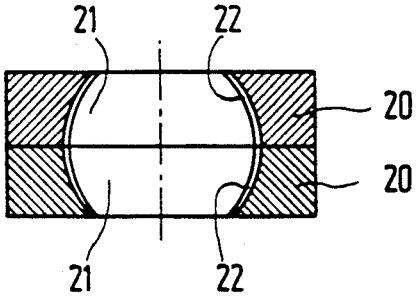
FIGS. 6, 7 and 8 are section views with show further examples of electrodes suitable for use in a display device according to the invention.
Figure 7:
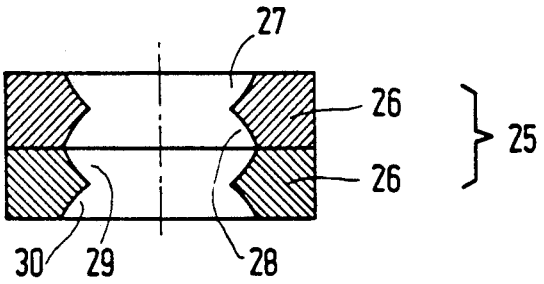
Figure 8:
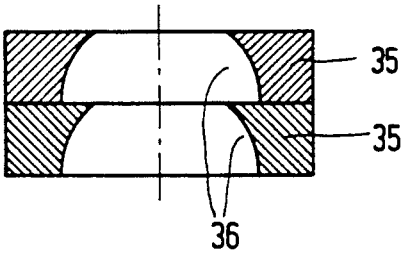

FIGS. 6 through 8 show cross-sections of further examples of electrodes which are suitable for use in the display device according to the invention.

FIG. 6 shows an electrode comprising two plates 20 having craters 21 coated with conducting layers 22, which plates are stacked in such a manner that the craters 21 are aligned and face each other.

FIG. 7 shows an electrode 25 comprising two plates 26 each plate provided with two intersecting craters 27, 28, 29 and 30, said pairs of intersecting craters aligned and facing each other.

FIG. 8 shows an electrode comprising two plates 35 having craters 36 which are aligned and face in the same direction.

In all these embodiments the conducting layers and the are arranged in such a manner as to shield the insulating layers from the electrons passing through the apertures, so that they cannot charge the insulating layers. In contrast, in FIGS. 1 and 2 insulating layer is partially exposed and can be charged by passing electrons.

Figure 9:
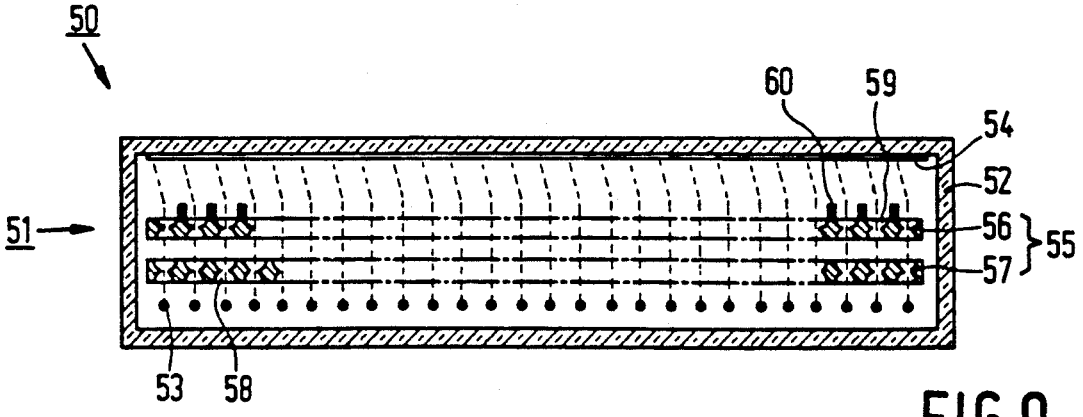
FIG. 9 is a display device according to the invention.

FIG. 9 is a sectional view of a display device according to the invention. Said display device 50 comprises a cathode-ray tube 51. Said cathode-ray tube 51 comprises a number of wire cathodes 53 and a display screen 54 in an evacuated envelope 52. A selection grid 55 is arranged between the wire cathodes 53 and the display screen 54. Said selection grid 55 comprises two electrodes 56 and 57. Each of these electrodes comprises rows of apertures 58 and 59, respectively, in which parts of conductor patterns are present. By applying voltages to the conductor patterns, electron beams can be made to selectively pass through the selection grid 55. In this manner, an image can be formed on the display screen 54. In the present example, deflection means 60 for deflecting the electron beams are arranged between the display screen 54 and the selection grid 55.

FIGS. 10 through 15 illustrate various stages of manufacture according to a method of the invention.

Figure 10:
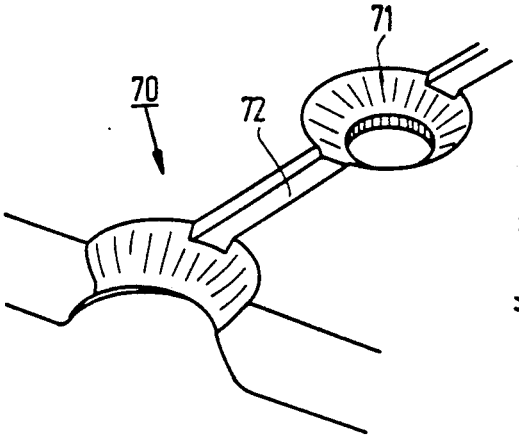
FIGS. 10 through 15 are illustrations of various stages of the manufacture according to a method of the invention.

As is shown in FIG. 10, a plate 70 is provided with apertures 71 and grooves 72. This can be carried out in a number of ways, for example, by etching, by scratching, by a laser machining or by spark erosion. Preferably, an etching process is used because this precludes the formation of sharp edges at the transition between the apertures and the grooves. It is difficult to deposit a continuous layer on a sharp edge in a reliable manner.

Figure 11:
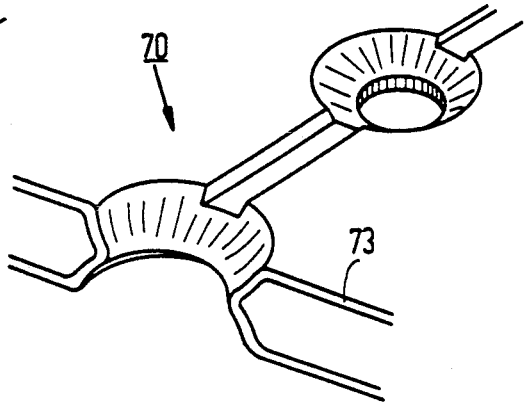
Figure 12:
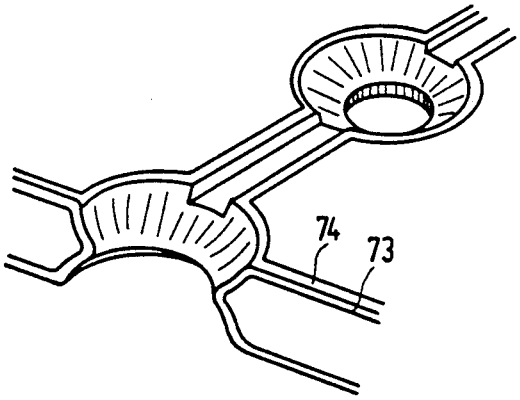

Subsequently, the plate is provided with a first insulating layer 73, as shown in FIG. 11. This can be carried out in a number of ways, for example, by providing the plate with an aluminium layer which is subsequently anodized, by applying a layer of an insulating substance to the plate by means of vacuum evaporation, by applying an insulating layer to the plate by means of CVD (Chemical Vapour Deposition), or in another manner, for example, by an electrophoretic coating process.

The first insulating layer extends at least over the part on which the recessed conductor pattern is to be formed at a later stage, in this example 1 the walls of the apertures and the grooves. Subsequently, a second layer 74 composed of a removable substance is for example a lacquer layer applied by a roller coating process. The use of a roller having a relatively large radius of curvature enables a lacquer layer 74 to be provided in such a manner that the craters and the grooves remain free from lacquer.

Although this is a preferred embodiment of the method according to the invention, the invention is not to be regarded as limited thereto. Alternative techniques, for example printing techniques, can also be used to provide the layer 74.

Figure 13:
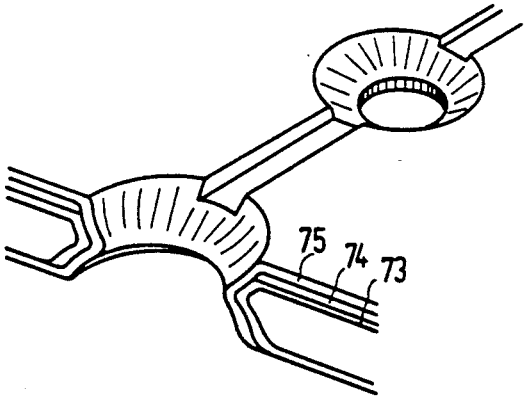
Figure 14:
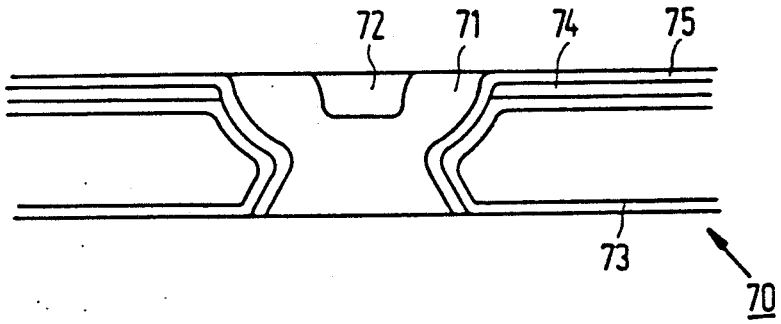
Figure 15:
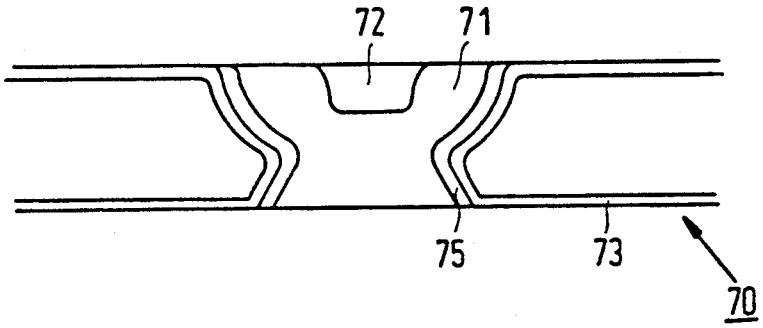

Subsequently, a conducting layer 75 is provided, as shown in the partly perspective elevational view of FIG. 13. FIG. 14 is a sectional view of the electrode thus obtained. The layer 75 can be provided in various ways, for example, by any of the methods described with respect to layer 73. Subsequently, the removable layer 74 is removed. A lacquer layer can be, for example, dissolved or removed by rubbing. FIG. 15 is a sectional view of the electrode obtained after layer 74 has been removed. In this manner, an electrode comprising a plate with recessed conductor patterns is manufactured in a simple manner.

A roller having a cross-section of 12 mm is used to apply a lacquer layer to an electrode having a pattern of craters and grooves, the interspace between the craters being of the order of one hundred to several hundreds of micrometers. Subsequently, an aluminium layer was provided by means of vacuum evaporation. Next, the lacquer layer was removed from the surface of the electrode taking the overlying aluminum layer with it. A layer of aluminium remained in the apertures and the grooves. Before the lacquer layer was removed from the electrode, the electrode was immersed in a solvent for the lacquer layer, for example 1 toluene, for several seconds. As a result, the lacquer layer can be removed more easily.

A polyimide layer was applied to an electrode by means of an offset-printing technique, an aluminium layer was provided thereon by means of vacuum evaporation.

Figure 16:
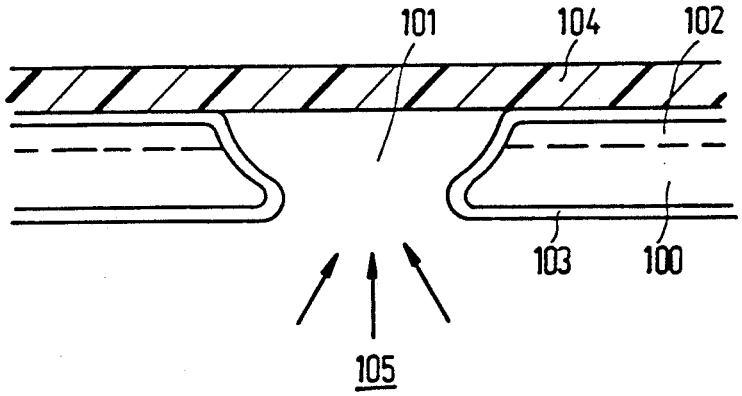
FIGS. 16 and 17 are illustrations of alternative methods according to the invention.

An alternative method according to the invention is illustrated in FIG. 16. Apertures 101 and grooves 102 are formed in a plate 100, after which the plate is provided with an insulating layer 103. Subsequently, a positive photoresist foil 104 is applied to the grooved side of the plate. Said photoresist foil is exposed, through the apertures as diagrammatically indicated by the arrows in FIG. 16. The exposed photoresist is then removed. It has been found that although the photoresist which is present above the grooves is not directly exposed, it can still be removed. Probably, the grooves and the photoresist above the grooves act as a light duct through which via reflections, photoresist which is not directly exposed also receives photons. Subsequently, a conducting layer is applied. Next, the remaining photoresist is removed leaving a conducting layer present on the walls of the apertures and the grooves.

Figure 17:
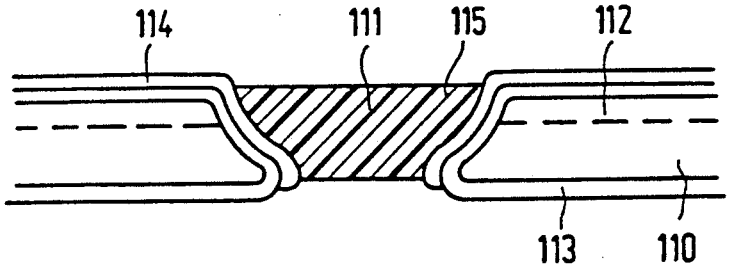

A further alternative method according to the invention is illustrated in FIG. 17. Plate 110 is provided with apertures 111 and grooves 112. Subsequently, said plate is provided with an electrically insulating layer 113 and a conducting material 114. Next, the apertures and the grooves are filled with a removable material 115, for example a wax. In the next step, the conducting material 114 which extends between the apertures is removed, for example, by rubbing or etching, after which the wax is removed, leaving a conducting layer on the walls of the apertures and the grooves.

It will be obvious that within the scope of the invention, many variations are possible to those skilled in the art. For example, the plate does not necessarily have to be flat. A curved plate may alternatively be used.

We claim:

1. A display device comprising a means for generating an electron beam and an electrode, said electrode comprising a plate defining a pattern of apertures for transmitting the electron beam and having a pattern of conductors for influencing the passage of the electron beam, the plate and the pattern being mechanically interconnected and electrically separated, characterized in that the pattern of conductors is constructed so as to be recessed in the plate.

2. A display device as claimed in claim 1, wherein each aperture is surrounded by a crater-shaped wall, grooves extend between the apertures, and the conductor pattern is located on the walls of the apertures and the walls of the grooves are provided with a conducting material.

3. A display device as claimed in claim 2, in which the pattern of conductors is separated from the plate by an insulating layer, and the insulating layer is screened from the electron beam by the pattern of conductors.

4. A display device as claimed in claim 1, in which the pattern of conductors is separated from the plate by an insulating layer, and the insulating layer is screened from the electron beam by the pattern of conductors.

5. A method of manufacturing a display device comprising means for generating an electron beam and an electrode, the electrode comprising a plate defining a pattern of apertures for transmitting the electron beam and having a pattern of conductors for influencing the passage of the electron beam, the plate and the pattern being mechanically interconnected and electrically separated, the method characterized in that grooves are formed between the apertures, an electrically insulating layer is provided covering at least the walls of the apertures and the grooves, the surface between the apertures and the grooves is covered with a further, removable layer, after which a conducting material is applied to at least the walls of the apertures and the grooves, after which the removable layer is removed from the surface between the apertures and the grooves.

6. A method as claimed in claim 5, wherein the removable layer is provided by means of roller coating.

7. A method as claimed in claim 6, wherein the removable layer is soluble in a solvent and the electrode is immersed in said solvent before the layer is removed.

8. A method as claimed in claim 6, wherein the apertures and the grooves are formed by etching.

9. A method as claimed in claim 5, wherein the removable layer is soluble in a solvent and the electrode is immersed in said solvent before the layer is removed.

10. A method as claimed in claim 9, wherein the apertures and the grooves are formed by etching.

11. A method as claimed in claim 5, wherein the apertures and the grooves are formed by etching.

12. A method of manufacturing a display device comprising means for generating an electron beam and an electrode, said electrode comprising a plate defining a pattern of apertures for transmitting the electron beam and having a pattern of conductors for influencing the passage of the electron beam, the plate and the pattern being mechanically interconnected and electrically separated, the method characterized in that the grooves are formed between the apertures, the plate is provided with an electrically insulating layer covering at least the walls of the apertures and the grooves, after which a conducting material is applied to at least the walls of the apertures and the grooves, after which a removable material is provided in the apertures and the grooves, after which any conducing material present between the apertures and the grooves not covered by the removable material is removed, and subsequently the removable material is removed from at least the apertures.

13. A method as claimed in claim 12, wherein the apertures and the grooves are formed etching.

14. A method of manufacturing a display device comprising a means for generating an electron beam and an electrode, the electrode comprising a plate defining a pattern of apertures for transmitting the electron beam and having a pattern of conductors for influencing the passage of the electron beam, the plate and the pattern being mechanically interconnected and electrically separated, the method characterized in that grooves are formed between the apertures, an electrically insulating layer is provided which covers at least the walls of the apertures and the grooves, after which a positive photoresist foil is applied to the grooved side of the plate, after which the photoresist foil is exposed through the apertures, after which the exposed photoresist is removed, and a conducting material is provided on at least the walls of the apertures and the grooves, after which the remaining photoresist is removed to leave the conducting material in the apertures and grooves.

15. A method as claimed in claim 14, wherein the apertures and the grooves are formed by etching.

* * * * *